US006333714B1

(12) United States Patent
Takahashi

(10) Patent No.: US 6,333,714 B1
(45) Date of Patent: Dec. 25, 2001

(54) ON-VEHICLE ANTENNA HAVING WIDE FREQUENCY RANGE

(75) Inventor: Toshiyuki Takahashi, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/638,819

(22) Filed: Aug. 14, 2000

(30) Foreign Application Priority Data

Aug. 18, 1999 (JP) ..... 11-231789
Mar. 1, 2000 (JP) ..... 12-056332

(51) Int. Cl.[7] ..... H01Q 1/38
(52) U.S. Cl. ..... 343/700 MS; 343/713; 343/828; 343/872
(58) Field of Search ..... 343/700 MS, 702, 343/713, 828, 829, 830, 846, 848, 872

(56) References Cited

U.S. PATENT DOCUMENTS 4,800,392 * 1/1989 Garay et al. ..... 343/700 MS
4,907,006 3/1990 Nishikawa et al. ..... 343/700 MS
5,291,210 * 3/1994 Nakase ..... 343/700 MS
5,365,246 * 11/1994 Rasinger et al. ..... 343/702
5,523,768 * 6/1996 Hemmie et al. ..... 343/840
6,002,367 * 12/1999 Engblom et al. ..... 343/700 MS
6,014,112 * 1/2000 Koscica et al. ..... 343/795
6,166,694 * 12/2000 Ying ..... 343/702

FOREIGN PATENT DOCUMENTS 11-4113 1/1999 (JP) .

* cited by examiner

*Primary Examiner*—Tho G. Phan
(74) *Attorney, Agent, or Firm*—Brinks Hofer Gilson & Lione

(57) ABSTRACT

An antenna includes at least two radiating conductors disposed in parallel and having different lengths, a feeding conductive section connected to the radiating conductors at the same-side ends in the parallel direction of the radiating conductors, and a grounding conductive plate disposed almost in parallel to the radiating conductors. In the antenna, a plurality of resonance points are generated by the plurality of radiating conductors having different lengths, the overall frequency characteristics of the antenna are improved in the frequency bands corresponding to the plurality of resonance points, and the operation frequency band of the antenna is widened.

18 Claims, 9 Drawing Sheets

ON-VEHICLE ANTENNA HAVING WIDE FREQUENCY RANGE

BACKGROUND OF THE INVENTION

1. Field of the Invention

The present invention relates to antennas, for example, mounted on vehicles and used for receiving terrestrial TV broadcasting.

2. Description of the Related Art

FIG. 9 shows a conventional on-vehicle antenna for receiving terrestrial TV broadcasting. This conventional antenna 50 is basically configured such that a rod-shaped radiating conductor 51 is adjusted so as to resonate at a desired frequency, and the radiating conductor 51 is mounted so that the mounting angle against a support base 52 with a support section 53 being used as a fulcrum can be adjusted freely. As shown in FIG. 10A and FIG. 10B, the antenna 50 is usually mounted at a window section 61 or a roof section 62 of a car 6.

In general, to remedy a drawback of fading, which occurs during mobile reception, a plurality of the antennas 50 are used to form a diversity-reception antenna system and the antenna having the maximum receiving level is selected.

Since the conventional antenna has a not-wide operation frequency band itself, however, additional circuits such as a tuning circuit and an amplifier circuit are used to receive a desired frequency band if it is necessary to cover a wide frequency range for TV broadcasting receiving and other purposes. In addition, since the conventional antenna needs a large space for installation and hence it is mounted outside a vehicle, it may be broken or stolen, or it may spoil the appearance of the vehicle.

SUMMARY OF THE INVENTION

Accordingly, it is an object of the present invention to provide an antenna which covers a wide frequency range, which can be made compact, and when the antenna is installed inside a vehicle, which is free from breakage, to decrease the probability of being stolen and which does not spoil the appearance of the vehicle.

The foregoing object is achieved according to the present invention through the provision of an antenna including at least two radiating conductors disposed in parallel and having different lengths; a feeding conductive section connected to the radiating conductors at the same side ends in the parallel direction of the radiating conductors; and a grounding conductive plate disposed almost in parallel to the radiating conductors.

Since the antenna having the above structure is provided with a plurality of radiating conductors having different lengths, a plurality of resonance points are generated by the plurality of radiating conductors and the grounding conductive plate. The overall frequency characteristics of the antenna are improved in the frequency bands corresponding to the plurality of resonant frequencies, and thus the operation frequency band of the antenna is extended. In addition, since each of the plurality of radiating conductors contributes to radiation, the substantial area contributing to radiation becomes large, and the radiation efficiency of the antenna can be increased.

When each of the plurality of radiating conductors is arranged in parallel, a more compact antenna is made than a general dipole antenna, where radiating conductors are disposed in line on the same straight line.

Therefore, according to an antenna of the present invention, since the radiating conductors are arranged in parallel, the antenna resonates at a plurality of frequencies to extend the operation bandwidth of the antenna. In addition, since the antenna can be made compact, it can be installed inside a vehicle to avoid breakage, to decrease the probability of being stolen and not to spoil the appearance of the vehicle.

It is preferred that the feeding conductive section have a shape which extends its width from a feeding point toward a connection end connected to the radiating conductors in the antenna according to the present invention in terms of wider bandwidth.

When the feeding conductive section has a shape which extends its width from the feeding end toward the connection end connected to the radiating conductors, the path length of a current flowing though the feeding conductive section becomes more flexible. In other words, since the resonant length can have a range, the antenna can be used in a wider bandwidth.

It is preferred that the radiating conductors be installed on an inner surface of a first case made from an insulating material, the grounding conductive plate be installed on an inner surface of a second case made from an insulating material, and the first case and the second case be combined to form the antenna, in terms of the protection of each conductive member constituting the antenna.

It is preferred that an insulating material used for the first case and the second case have a not-large loss and a good heat resistance, for example, that ABS resin be used.

It is preferred that the radiating conductors and the grounding conductive plate be installed on an inner surface of any one of a plurality of divided, insulating cases, in terms of easy connection work for connecting each conductive member to the feeder.

Also in this case, it is preferred that an insulating material used for the plurality of divided, insulating cases have a not-large loss and a good heat resistance, for example, that ABS resin be used.

It is preferred that the radiating conductors and the feeding conductive section be formed by bending one metal plate, in terms of reducing the number of machining processes.

When the radiating conductors and the feeding conductive section are formed by bending one metal plate, electric losses at the connection sections of the radiating conductors and the feeding conductive section are reduced.

The radiating conductors are made from highly conductive metal plates, such as copper and aluminum.

It is preferred that the radiating conductors, the feeding conductive section, and the grounding conductive plate be formed on a surface of a base member made from an insulating material, in terms of making a support for each conductive member robust. It is also possible that conductive film formed on the whole surfaces of the base member is etched to generate each conductive pattern at a time.

It is preferred that the base member be made from high frequency, relatively-small-loss, dielectric ceramic or resin.

DESCRIPTION OF THE PREFERRED EMBODIMENTS

Embodiments of the present invention will be described below in detail.

Figure 1:
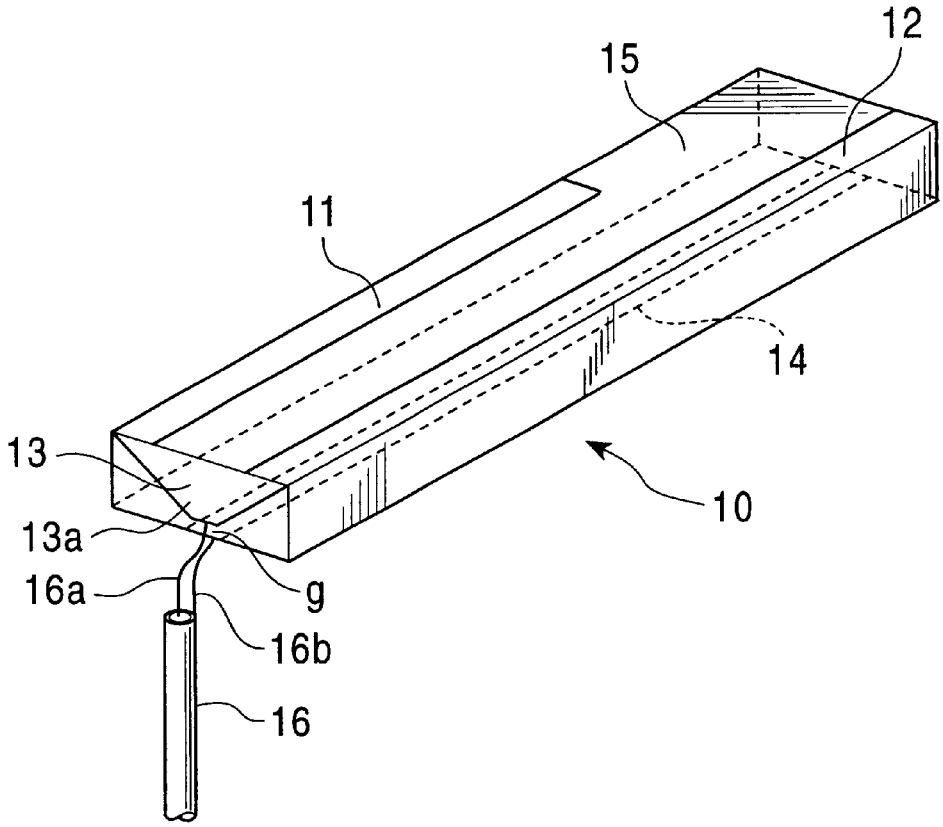
FIG. 1 is a perspective view of an antenna according to a first embodiment of the present invention.

FIG. 1 is a perspective view of an antenna according to a first embodiment of the present invention.

The antenna 10 according to the first embodiment is formed of a first radiating conductor 11 and a second radiating conductor 12 disposed in parallel but having different lengths, a feeding conductive section 13 connected to the radiating conductors 11 and 12 at one-side ends in the parallel direction of the radiating conductors 11 and 12, a grounding conductive plate 14 disposed almost parallel to the radiating conductors 11 and 12, and a base member 15 serving as a support for the above conductive members.

The specific dimensions of the antenna 10 according to the first embodiment, shown in FIG. 1, are outlined below. The first radiating conductor 11 and the second radiating conductor 12 are 85 mm long and 120 mm long, respectively, and both are 5 mm wide. The first radiating conductor 11 and the second radiating conductor 12 are disposed 10 mm apart. The feeding conductive section 13 has the shape of almost a triangle which extends its width from a tip section 13*a* toward the connection end connected to the first radiating conductor 11 and the second radiating conductor 12.

The connection side is 20 mm wide and the feeding conductive section 13 is 10 mm high. The feeding conductive section 13 is formed together with the first radiating conductor 11 and the second radiating conductor 12 as a unit. They are formed in a desired structure by bending a metallic plate.

The grounding conductive plate 14 is 95 mm long and 5 mm wide. The antenna is 120 mm long, 20 mm wide, and 12 mm high as a whole. A 2-mm gap "g" is generated between the tip section 13*a* of the feeding conductive section 13 and the grounding conductive plate 14. Feeding is performed at the gap "g." The operation frequency band (a band having a standing-wave ratio of less than 2) of the antenna is about 670±40 MHz (a bandwidth ratio range of about 12%).

The inner conductor 16*a* and the outer conductor 16*b* of a coaxial feeder 16 are directly soldered to the feeding conductive section 13 and the grounding conductive section 14, respectively, for feeding. Alternatively, the inner conductor and the outer conductor of a connector (not shown) formed of the inner conductor, the outer conductor, and a dielectric disposed therebetween are electrically connected to the feeding conductive section 13 and the grounding conductive section 14, respectively, and a feeder is connected through the connector.

The first radiating conductor 11, the second radiating conductor 12, the feeding conductive section 13, and the grounding conductive plate 14 are made from highly conductive metals, such as copper and aluminum.

It is preferred that the base member 15, serving as a support, be made from a foaming agent having a relative dielectric constant close to 1 in order to provide a wide-band characteristic. If a narrow-band characteristic is allowed, it is also possible that a dielectric having a large relative dielectric constant is used to make the antenna compact due to the effect of wavelength reduction.

The conductive member formed, as a unit, of the first radiating conductor 11, the second radiating conductor 12, and the feeding conductive section 13 is mounted on the base member 15 by adhesion or other methods.

Since the antenna according to the first embodiment is structured as described above, a plurality of resonance points are generated to broaden the operation bandwidth. In addition, since a relatively compact antenna is implemented, it can be installed inside a vehicle.

Figure 2:
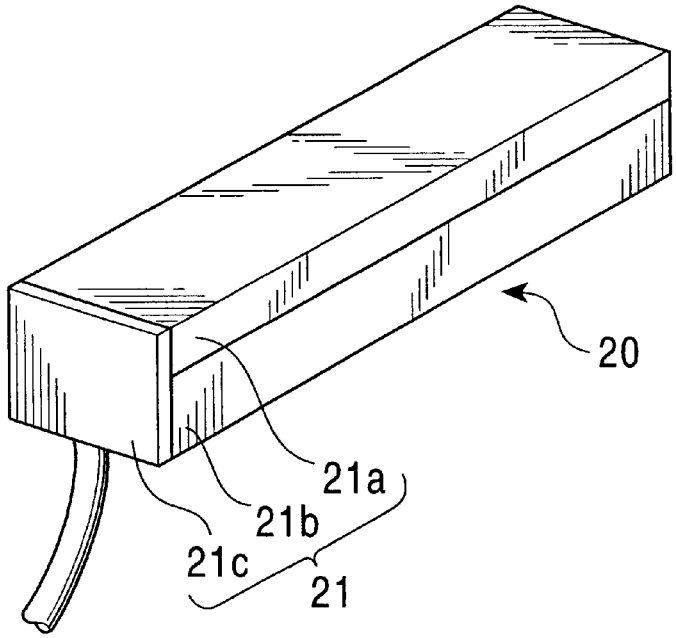
FIG. 2 is a perspective view of an antenna according to a second embodiment of the present invention.
Figure 3:
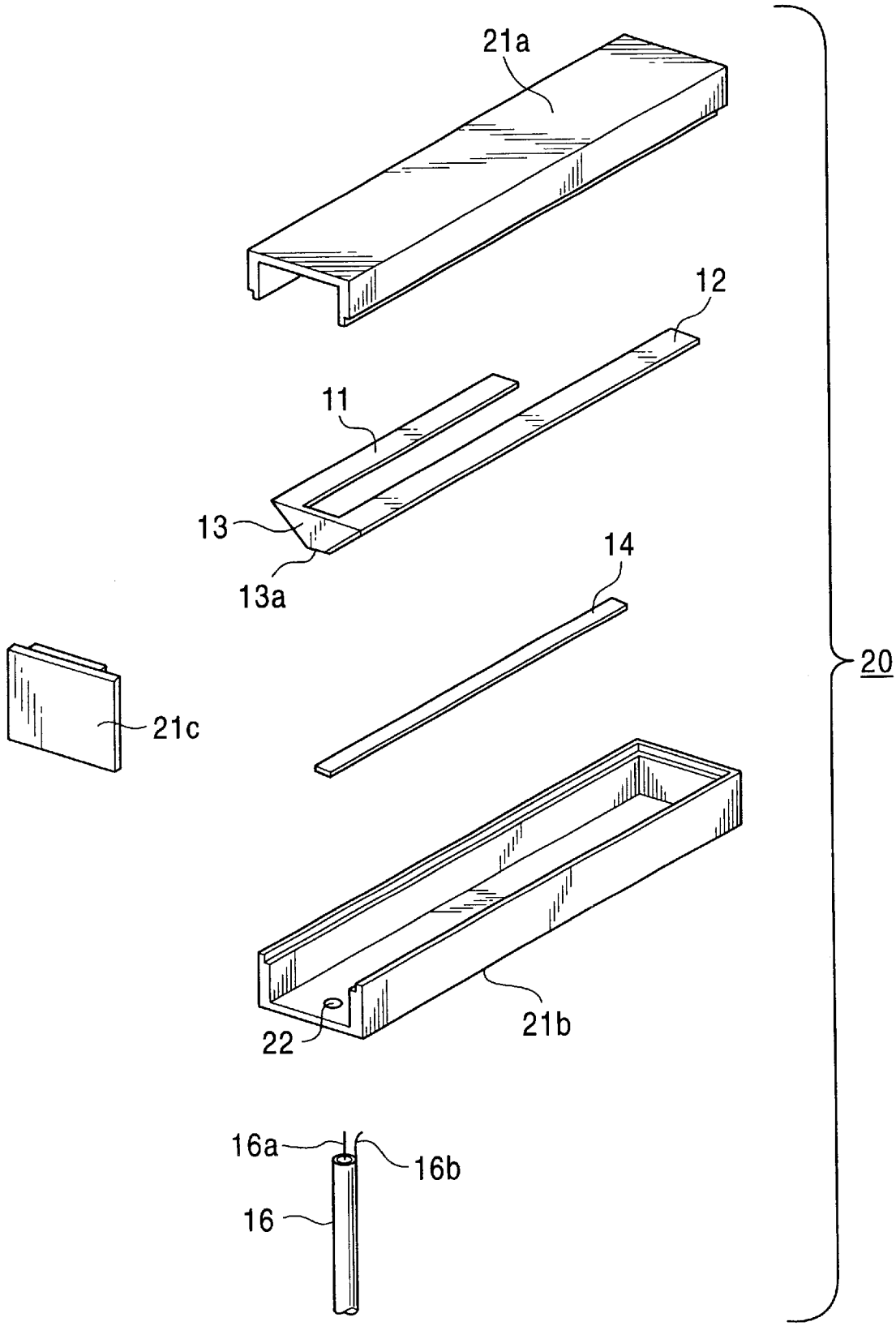
FIG. 3 is an exploded perspective view of the antenna shown in FIG. 2.

FIG. 2 is a perspective view of an antenna according to a second embodiment of the present invention. FIG. 3 is an exploded perspective view of the antenna.

The antenna 20 according to the second embodiment, shown in FIGS. 2 and 3, differs from the antenna according to the first embodiment, shown in FIG. 1, in that each conductive member constituting the antenna 20 is not mounted on a base member, serving as a support, but installed on the inside surface of a first case 21*a* or a second case 21*b* partly constituting an insulating case 21. Since the other members are the same as those in the antenna according to the first embodiment, the same symbols as those used in FIG. 1 are assigned to the other members.

In the antenna 20 according to the second embodiment, the conductive member formed, as a unit, of a first radiating conductor 11, a second radiating conductor 12, and a feeding conductive section 13 by bending is mounted on the inside surface of the first case 21*a* made from an insulating material, and a grounding conductive plate 14 is mounted on the inside surface of the second case 21*b* made from an insulating material. The first case 21*a* and the second case 21*b* are combined to form the antenna 20.

The conductive member formed, as a unit, of the first radiating conductor 11, the second radiating conductor 12, and the feeding conductive section 13 is mounted on the inside surface of the first case 21*a* by adhesion or fitting in. The grounding conductive plate 14 is mounted on the inside surface of the second case 21*b* in the same way.

When the first case 21*a* and the second case 21*b* are combined after the corresponding conductive members are installed thereon, the cases form an opening at a position opposite the feeding conductive section 13. The antenna 20 is connected to a coaxial feeder 16 or to a connector through this opening, and then a third case 21*c* is fit into the opening after the connection, to cover all conductive members with the case 21 for protection.

A hole 22 is provided for a part (the second case 21*b* in this case) of the case 21. The coaxial feeder 16 is connected through the hole 22, or the connection section for connecting the connector to a feeder is disposed outside the case by the use of the hole 22.

It is preferred that the case 21 be made from a material having a not-large loss and a good heat resistance, such as ABS resin.

Since the antenna according to the second embodiment has the above structure, it gives the same advantages as the antenna according to the first embodiment. In addition, since the conductive members of the antenna is covered with the insulating case, they are protected from breakage and contact with other members.

In the above embodiments, the first and second radiating conductors, the feeding conductive member, and the grounding conductive plate are made of metal plates. The whole or a part of these conductive members may be formed on a surface of the base member or on the inside surface of the case by etching or other methods.

In the above embodiments, the first and second radiating conductors are formed only on a surface of the insulating base member or on one inside surface of the case. The first and second radiating conductors may be formed on two or more surfaces by extending and bending the first and second radiating conductors to other surfaces connected in the longitudinal direction or in the transverse direction. The same condition is also applied to the grounding conductive plate.

Figure 4:
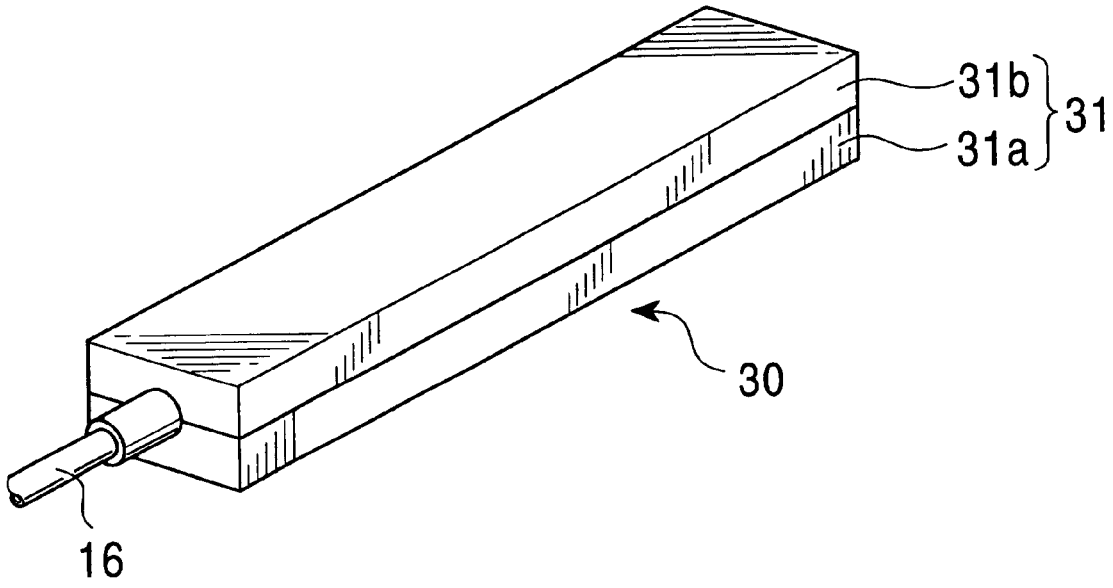
FIG. 4 is a perspective view of an antenna according to a third embodiment of the present invention.
Figure 5:
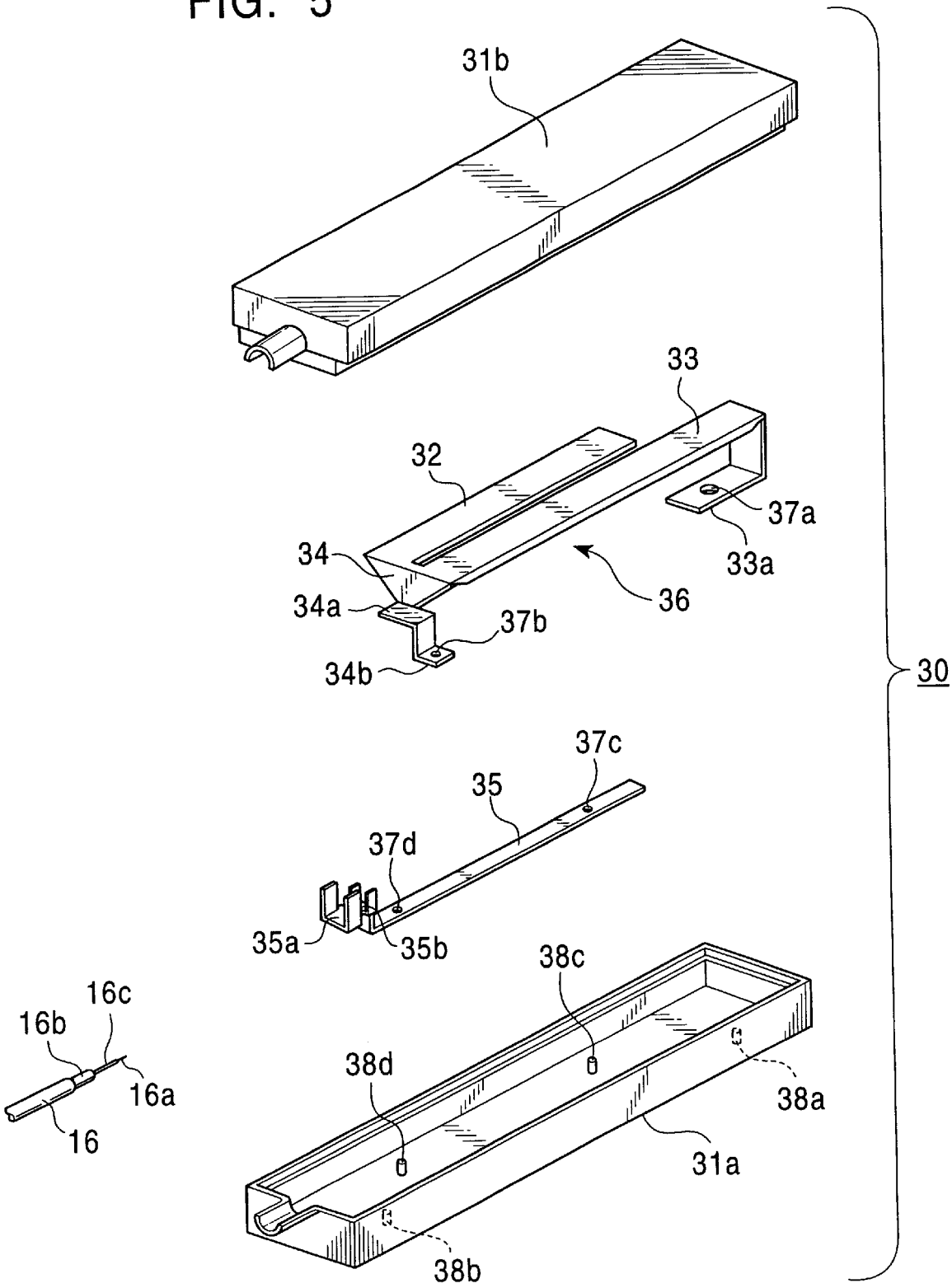
FIG. 5 is an exploded perspective view of the antenna shown in FIG. 4.

FIG. 4 is a perspective view of an antenna according to a third embodiment of the present invention. FIG. 5 is an exploded perspective view of the antenna, and FIG. 6 is a plan showing the installation condition of each conductive member.

Figure 6:
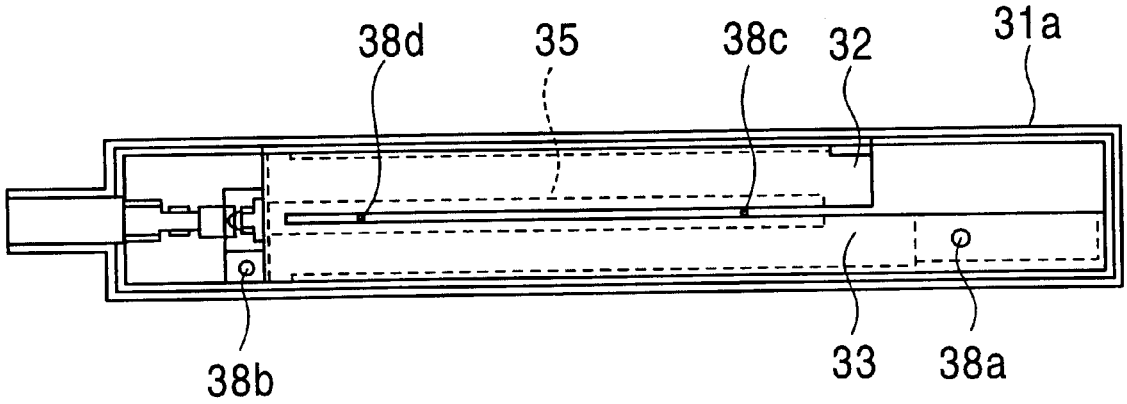
FIG. 6 is a plan showing the installation condition of each conductive member in the antenna shown in FIG. 4.

The antenna 30 according to the third embodiment, shown in FIG. 4 to FIG. 6, is formed of a first case 31*a* and a second case 31*b* constituting an insulating case 31, a first radiating conductor 32 and a second radiating conductor 33 arranged in parallel and having different lengths, a feeding conductive section 34 connected to the radiating conductors 32 and 33 at the same-side ends in the parallel direction of the radiating conductors 32 and 33, and a grounding conductive plate 35 disposed almost in parallel to the radiating conductors 32 and 33. The antenna 30 differs most from the antenna according to the second embodiment in that each conductive member constituting the antenna 30 is installed on the inside surfaces of the first case 31*a*.

The first radiating conductor 32, the second radiating conductor 33, and the feeding conductive section 34 form a radiating conductive element 36. In the same way as in the above first and second embodiments, the radiating conductive element 36 is also formed by bending as a unit. A tip of the second radiating conductor 33 is bent twice in a U shape with two right angles to form an installation section 33*a*. The installation section 33*a* is provided with an insertion hole 37*a*. At a tip of the feeding conductive section 34, a receiving section 34*a* and an installation section 34*b* are formed by bending in steps. The installation section 34*b* is provided with an insertion hole 37*b*. The receiving section 34*a* is used for connecting the inner conductor 16*a* of a coaxial feeder 16. The installation section 34*b* and the installation section 33*a*, formed at a tip of the second radiating conductor 33, are used for securing the radiating conductive element 36 to an inner surface of the first case 31*a*.

At a tip of the grounding conductive plate 35, a first receiving section 35*a* for connecting the outer conductor 16b of the coaxial feeder 16 and a second receiving section 35*b* for holding the insulator 16*c* of the coaxial feeder 16 are formed. The coaxial feeder 16 is positively secured to the grounding conductive plate 35 by the second receiving section 35*b*. The grounding conductive plate 35 is also provided with a pair of insertion holes 37*c* and 37*d*.

Protrusions 38*a* to 38*d* formed upright at predetermined positions on an inner surface of the first case 31*a* are inserted into the insertion holes 37*a* and 37*b* of the installation sections 33*a* and 34*b* and to the insertion holes 37*c* and 37*d* of the grounding conductive plate 35, and the tips of the protrusions 38*a* to 38*d* are caulked or adhered to secure the radiating conductive element 36 and the grounding conductive plate 35 to the inner surface of the first case 31*a*. As shown in FIG. 6, the grounding conductive plate 35 is opposed to the radiating conductive element 36 at the center of the inner surface of the first case 31*a*. The slit-shaped gap formed between the first radiating conductor 32 and the second radiating conductor 33 is positioned right above the grounding conductive plate 35.

In the antenna according to the third embodiment, after the radiating conductive element 36 and the grounding conductive plate 35 are secured to the inner surface of the first case 31*a*, the inner conductor 16*a* of the coaxial feeder 16 is soldered to the receiving section 34*a* of the feeding conductive section 34, the outer conductor 16*b* is soldered to the first receiving section 35*a* of the grounding conductive plate 35, and the second receiving section 35*b* of the grounding conductive plate 35 is crimped to clamp the insulator 16c of the coaxial feeder 16. Then, the first case 31*a* is combined with the second case 31*b* to form the case 31. Both cases 31*a* and 31*b* are secured to each other by a snap, by a screw, or by adhesive to form the antenna 30 shown in FIG. 4.

According to the antenna of the third embodiment, the above structure gives the same advantages as those provided by the antenna according to the second embodiment. In addition, since both conductive members, the radiating conductive element and the grounding conductive plate, are installed in one of the two divided cases, each conductive member can be easily connected to the feeder in a large space, and various tests, including a continuity test and a characteristic test, can be executed before both cases are combined to form the antenna.

Figure 7:
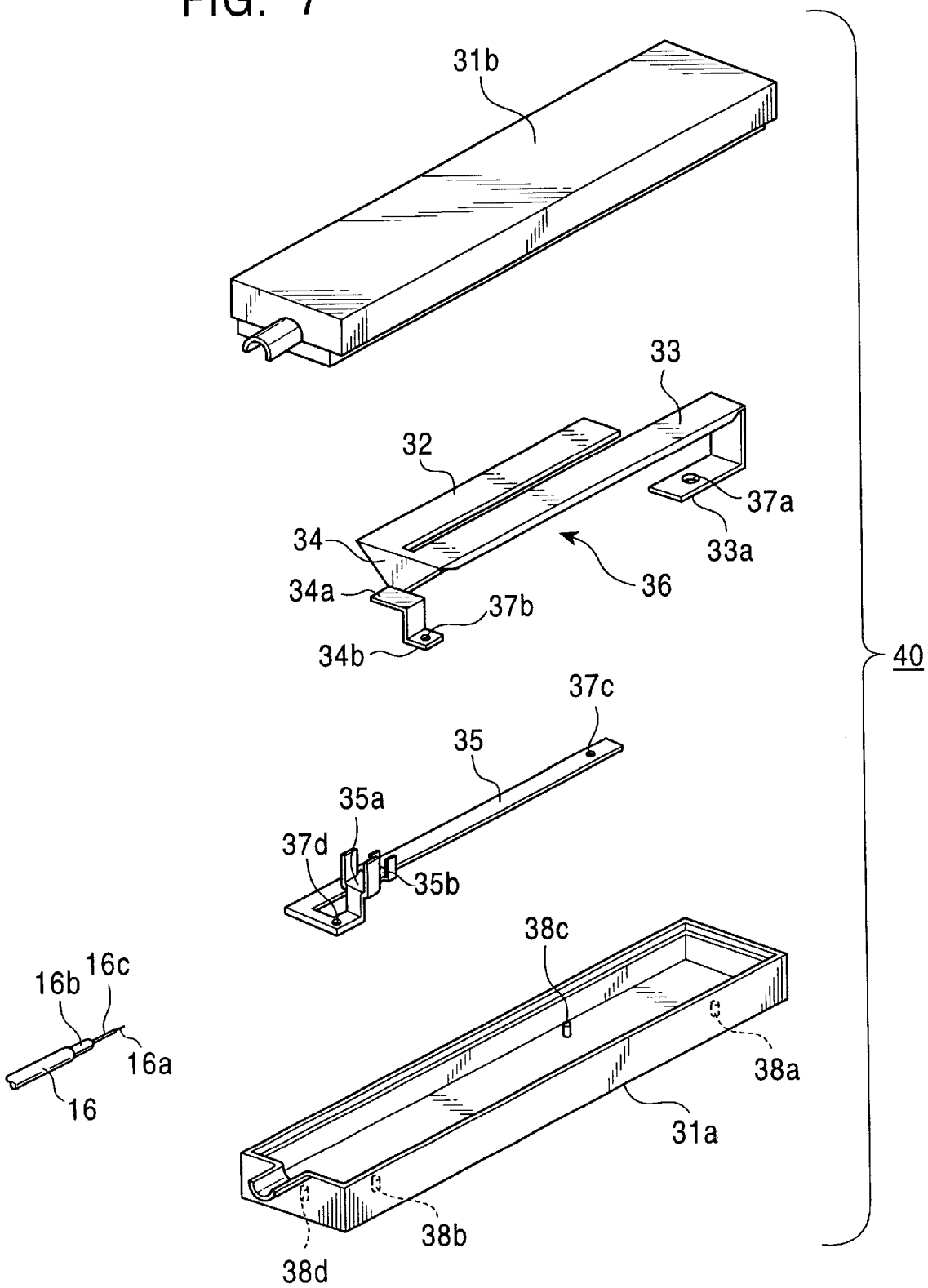
FIG. 7 is an exploded perspective view of an antenna according to a fourth embodiment of the present invention.
Figure 8:
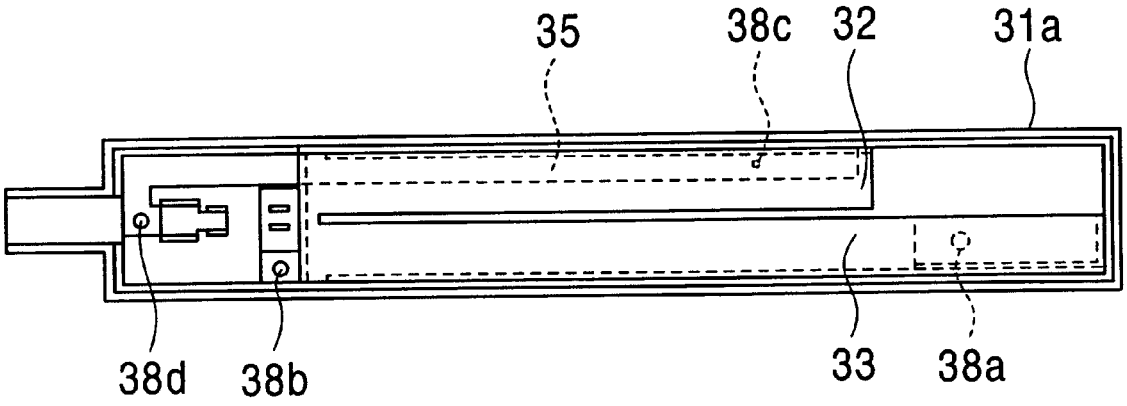
FIG. 8 is a plan showing the installation condition of each conductive member in the antenna shown in FIG. 7.
Figure 9:
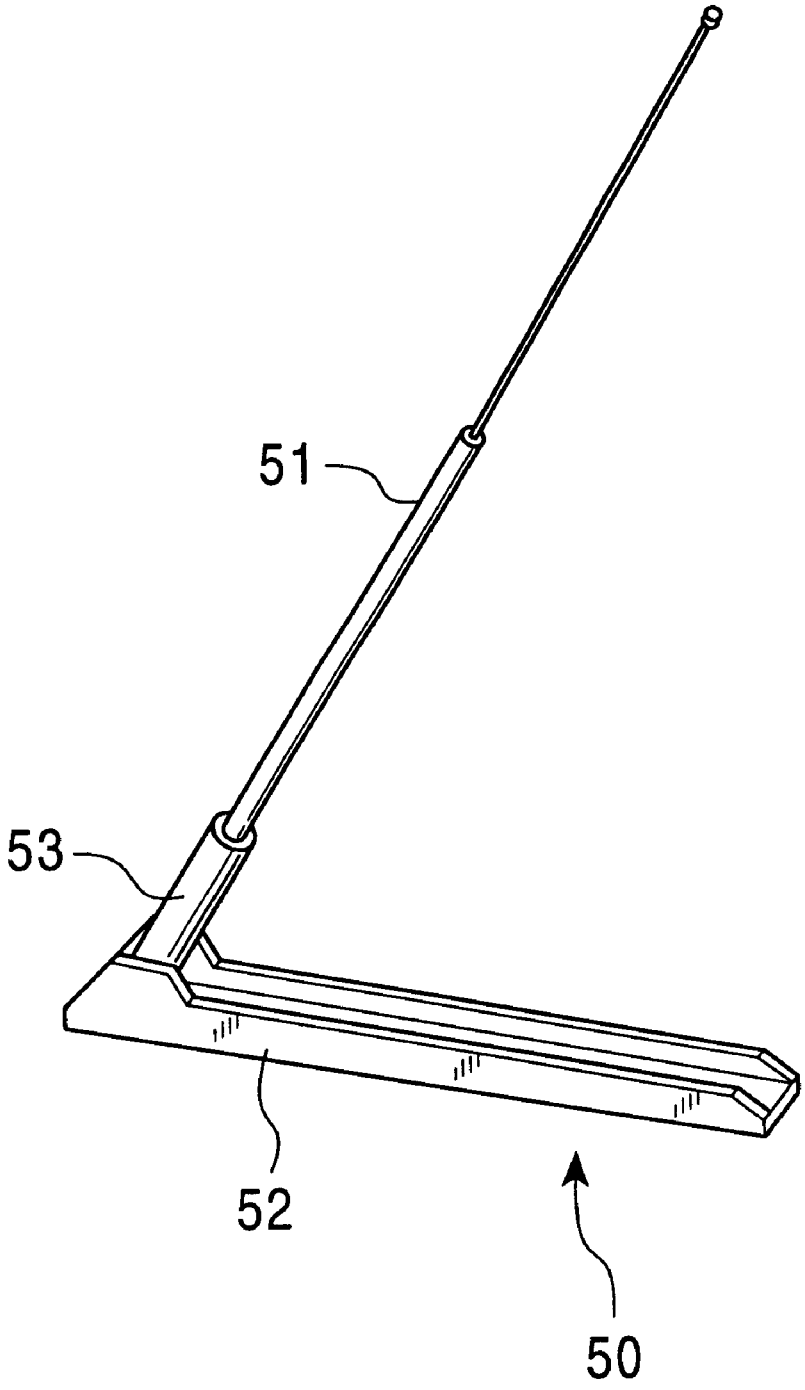
FIG. 9 PRIOR ART
FIG. 9 is a perspective view showing the structure of a conventional antenna.
Figure 10A:
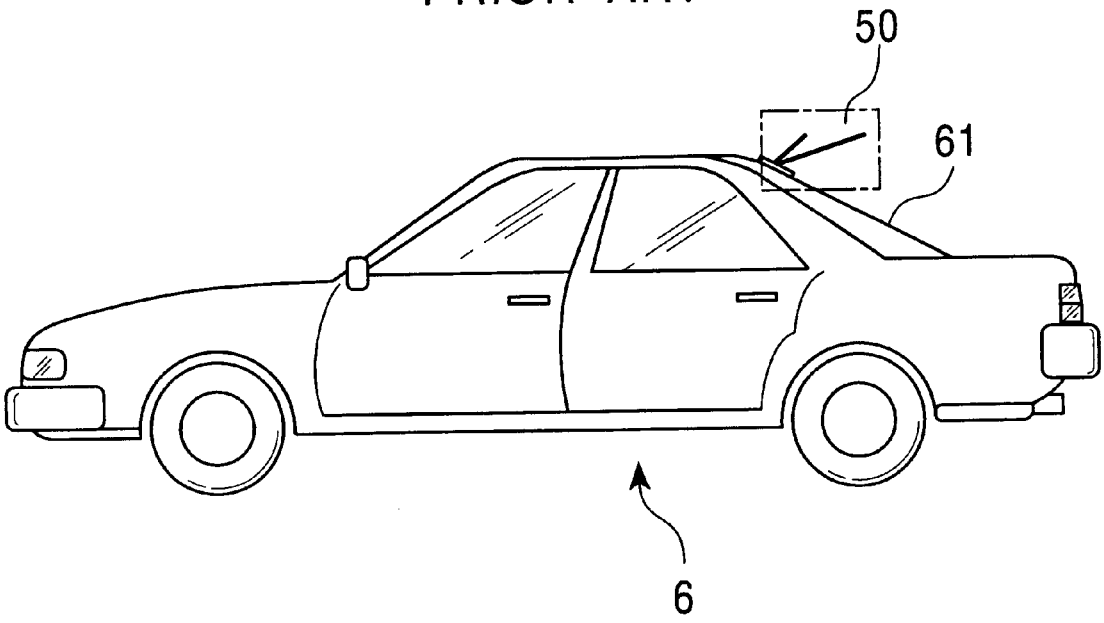
FIG. 10A PRIOR ART
FIG. 10A and FIG. 10B are perspective views showing how the conventional antenna is installed.
Figure 10B:
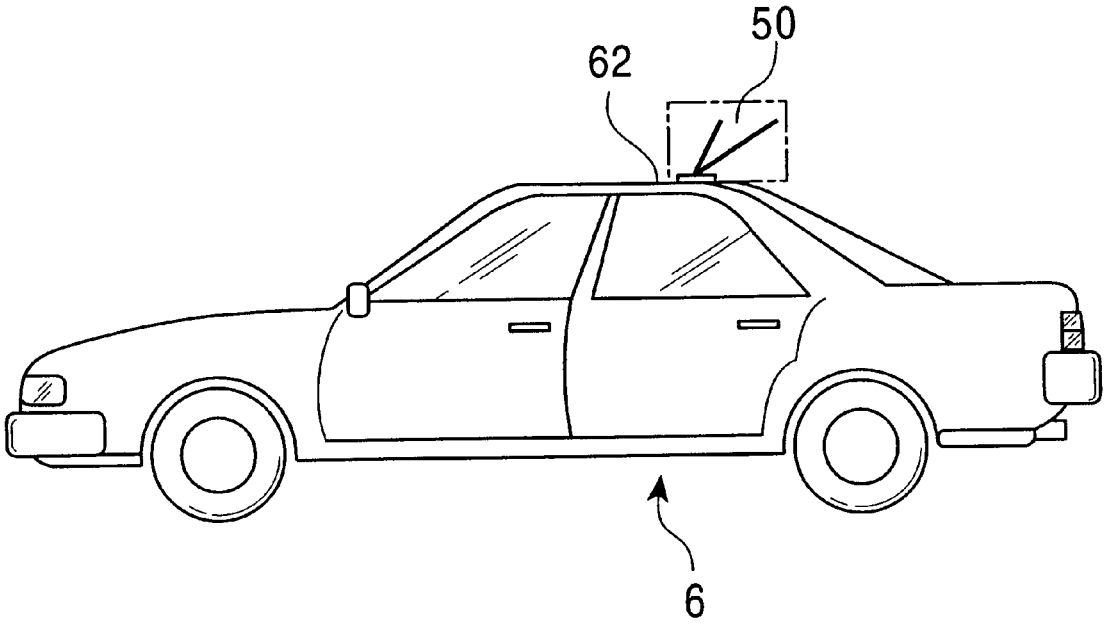
FIG. 10B PRIOR ART

FIG. 7 is an exploded perspective view of an antenna according to a fourth embodiment of the present invention. FIG. 8 is a plan showing the installation condition of each conductive member.

The antenna according to the fourth embodiment of the present invention, shown in FIGS. 7 and 8, differs from the antenna according to the third embodiment, shown in FIG. 4 to FIG. 6, in that the grounding conductive plate 35 is disposed not at the center of the first case 31*a* but near an edge of the first case 31*a*. The whole shape of the grounding conductive plate 35 and the positions where the protrusions 38*c* and 38*d* are formed in the first case 31*a* are slightly different accordingly. Since the other portions are the same as those in the antenna of the third embodiment, the same symbols as those used for the antenna according to the third embodiment are assigned to the other portions and a description thereof is omitted.

According to the fourth embodiment, the above structure gives the same advantages as those provided by the antenna according to the third embodiment. In addition, the grounding conductive plate is disposed near one edge of one case, the distance between one radiating conductor of the radiating conductive element and the grounding conductive plate is made longer and therefore, the antenna is suited to form a thin antenna.

What is claimed is:

1. An antenna comprising:

at least two radiating conductors disposed in parallel and having different lengths, the radiating conductors having a first gap therebetween;

a feeding conductive section connected to said radiating conductors at one end, the feeding conductive section extending in direction perpendicular to a parallel direction of said radiating conductors; and a grounding conductive plate disposed substantially in parallel to said radiating conductors, the grounding conductive plate separated from the radiating conductors by a second gap in the direction perpendicular to the parallel direction of the radiating conductors, a width of the grounding plate being smaller than a combined width of the radiating conductors and the first gap.

2. An antenna according to claim 1, wherein said feeding conductive section has a width that increases from a feeding end toward a connection end connected to said radiating conductors.

3. An antenna according to claim 2, wherein the feeding conductive section is substantially triangular.

4. An antenna according to claim 1, wherein said radiating conductors are installed on an inner surface of a first case made from an insulating material;

said grounding conductive plate is installed on an inner surface of a second case made from an insulating material; and the first case and the second case are combined to form said antenna.

5. An antenna according to claim 1, wherein said radiating conductors and said grounding conductive plate are installed on an inner surface of any one of a plurality of divided, insulating cases.

6. An antenna according to claim 5, wherein the inner surface of the case to which the radiating conductors and the grounding conductive plate are installed comprises a plurality of protrusions, the radiating conductors installed on a first set of the plurality of protrusions and the grounding conductive plate installed on a second set of plurality of protrusions.

7. An antenna according to claim 6, wherein a longer of the radiating conductors includes a tip having an insertion hole secured to one of the first set of the plurality of projections and the feeding conductive section includes a tip having an insertion hole secured to another of the first set of the plurality of projections, and the grounding conductive plate has insertion holes secured to the second set of plurality of protrusions.

8. An antenna according to claim 7, wherein the tip of the longer of the radiating conductor is U-shaped and tip of the feeding conductive section has a step shape combination of a receiving section and an installation section, the installation section having the insertion hole secured to the another of the first set of the plurality of projections, the receiving section connected with a signal source.

9. An antenna according to claim 8, wherein the grounding conductive plate has a tip having a first receiving section and a second receiving section, the first receiving section of the grounding conductive plate connected with a ground source accompanying the signal source and the second receiving section of the grounding conductive plate connected with an insulation source accompanying the signal source.

10. An antenna according to claim 5, wherein the grounding conductive plate is installed in substantially a center of the inner surface of the case.

11. An antenna according to claim 5, wherein the grounding conductive plate and radiating conductors are installed in opposing sides of the inner surface of the case.

12. An antenna according to claim 1, wherein said radiating conductors and said feeding conductive section are formed by bending one metal plate.

13. An antenna according to claim 1, wherein said radiating conductors, said feeding conductive section, and said grounding conductive plate are formed on a surface of a base member made from an insulating material.

14. An antenna according to claim 1, wherein the width of the grounding conductive plate is at most a width of the first gap.

15. An antenna according to claim 1, wherein the first gap is less than twice the second gap.

16. An antenna according to claim 1, wherein the width of the grounding conductive plate is substantially equal to a width of one of the radiating conductors.

17. An antenna according to claim 1, wherein a third gap between an end of the conductive section unconnected with the radiating conductors and the grounding conductive plate is substantially less than the first gap.

18. An antenna according to claim 1, wherein the antenna is mounted on a vehicle.

* * * * *